US010555628B2

(12) United States Patent
Szekeresh et al.

(10) Patent No.: US 10,555,628 B2
(45) Date of Patent: Feb. 11, 2020

(54) MULTI-CLIMATE SLEEPING BAG

(71) Applicant: The North Face Apparel Corp., Wilmington, DE (US)

(72) Inventors: Daniel Kenly Szekeresh, Oakland, CA (US); Cory Michael Olson, Alameda, CA (US); Daniel Norris Rogers, Tiburon, CA (US); Andrew Coutant, Dublin, CA (US)

(73) Assignee: The North Face Apparel Corp., Wilmington, DE (US)

( * ) Notice: Subject to any disclaimer, the term of this patent is extended or adjusted under 35 U.S.C. 154(b) by 113 days.

(21) Appl. No.: 15/385,142

(22) Filed: Dec. 20, 2016

(65) Prior Publication Data

US 2018/0168373 A1 Jun. 21, 2018

(51) Int. Cl.
*A47G 9/08* (2006.01)

(52) U.S. Cl.
CPC ..... *A47G 9/086* (2013.01); *A47G 9/08* (2013.01)

(58) Field of Classification Search
CPC . A47G 9/00; A47G 9/06; A47G 9/066; A47G 9/08; A47G 9/086
See application file for complete search history.

(56) References Cited

U.S. PATENT DOCUMENTS 2,064,458 A * 12/1936 Bulpit ..... A47G 9/0207 139/420 R
2,368,220 A 1/1945 Hinds
3,584,323 A * 6/1971 Worley ..... A47G 9/086 2/69.5
3,988,791 A * 11/1976 Simon ..... A47G 9/086 5/413 R
5,343,578 A * 9/1994 Kettenhofen ..... A47G 9/086 2/69.5
5,386,602 A 2/1995 Krenzler
(Continued)

FOREIGN PATENT DOCUMENTS

CN 202636378 U 1/2013
EP 0095551 12/1983
(Continued)

OTHER PUBLICATIONS

Pace Measom, Warmth to the Wise: Temperature Ratings for Sleeping Bags Decoded, Apr. 5, 2014, Backcountry.com. (Year: 2014).*

*Primary Examiner* — David R Hare
(74) *Attorney, Agent, or Firm* — Smith, Gambrell & Russell LLP

(57) ABSTRACT

Multi-climate sleeping bags and methods of making the same are described. One sleeping bag may comprise a bottom panel comprising a head end and a foot end, wherein the bottom panel is formed from an inner shell, an outer shell, and an insulating material disposed between the inner shell and the outer shell, a first top panel comprising an inner shell, an outer shell, and an insulating material disposed between the inner shell and the outer shell, a first fastening mechanism configured to detachably couple an edge of the first top panel to an edge of the bottom panel, a second top panel comprising an inner shell, an outer shell, and an insulating material disposed between the inner shell and the outer shell, and a second fastening mechanism configured to detachably couple an edge of the second top panel to the edge of the bottom panel.

17 Claims, 5 Drawing Sheets

(56) References Cited

U.S. PATENT DOCUMENTS

| | | | | |
|---|---|---|---|---|
| 5,640,725 | A * | 6/1997 | Ando | A47C 27/128 5/413 AM |
| 5,706,532 | A | 1/1998 | Kettenhofen | |
| 6,018,830 | A | 2/2000 | Howe | |
| 6,334,221 | B1 * | 1/2002 | Hope | A41D 10/00 2/69 |
| 6,449,787 | B1 * | 9/2002 | Thorne | A47G 9/086 2/69.5 |
| 6,557,192 | B2 | 5/2003 | Zheng | |
| 7,752,690 | B1 * | 7/2010 | Seth | A47G 9/086 2/69.5 |
| 2010/0242172 | A1 | 9/2010 | Lijesen et al. | |
| 2012/0260394 | A1 | 10/2012 | Poore et al. | |
| 2014/0345051 | A1 * | 11/2014 | Benninger | A47G 9/086 5/413 R |

FOREIGN PATENT DOCUMENTS

| | | |
|---|---|---|
| EP | 2087816 A1 | 8/2009 |
| GB | 2284150 | 5/1995 |
| GB | 2397218 | 7/2004 |

* cited by examiner

MULTI-CLIMATE SLEEPING BAG

FIELD

This application is generally related to sleeping bags, and more particularly, to multi-climate sleeping bags and methods of using the same.

BACKGROUND

A sleeping bag typically includes first and second opposed halves defining a sleeping compartment therebetween and which are connected in such a way to define an entrance aperture at an entrance side or end of the sleeping bag. The sleeping bag may include insulation. Very lightweight, compressible insulation materials, such as water fowl down, are extremely desirable since they are able to provide sufficient insulation while being light weight and easily compressed. When used as an insulation material in sleeping bags, the down is easily compressed from the outside by the weight of the bag materials and from the inside by the user pushing outward. Depending on conditions a user is expected to encounter, the user may select a particular sleeping bag having a limit rating that is suitable in the expected conditions.

SUMMARY

There is need for convertible multi-climate sleeping bags that may provide comfort and safety in various temperatures and environmental conditions. Multi-climate sleeping bags and methods of making the same are described herein. Multi-climate sleeping bags may comprise a bottom panel comprising a head end and a foot end, wherein the bottom panel is formed from an inner shell, an outer shell, and an insulating material disposed between the inner shell and the outer shell, a first top panel comprising an inner shell, an outer shell, and an insulating material disposed between the inner shell and the outer shell, a first fastening mechanism configured to detachably couple a portion (e.g., edge, edge disposed adjacent a draft tube, etc.) of the first top panel to a portion (e.g., edge) of the bottom panel. Multi-climate sleeping bags may comprise a second top panel comprising an inner shell, an outer shell, and an insulating material disposed between the inner shell and the outer shell. Alternatively, the first or second top layer may be formed from a single layer of insulating material or single layer of a waterproof coated fabric. A second fastening mechanism may be configured to detachably couple a portion (e.g., edge) of the second top panel to a portion (e.g., edge) of the bottom panel. In certain aspects, the first fastening mechanism and the second fastening mechanism are disposed adjacent one another. In certain aspects, the first fastening mechanism and the second fastening mechanism may comprise a zipper-type fastener having a zipper pull and associated slider paths disposed on each of the panels to be selectively attached and detached, as described herein. Draft tubes and other thermal management elements may be included and may be disposed adjacent any portion of the sleeping bags, for example, the fastener mechanisms.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

BRIEF DESCRIPTION OF THE DRAWINGS

In order to facilitate a fuller understanding of the invention, reference is now made to the accompanying drawings, in which like elements are referenced with like numerals. These drawings should not be construed as limiting the invention and intended only to be illustrative.

DETAILED DESCRIPTION

Figure 1:
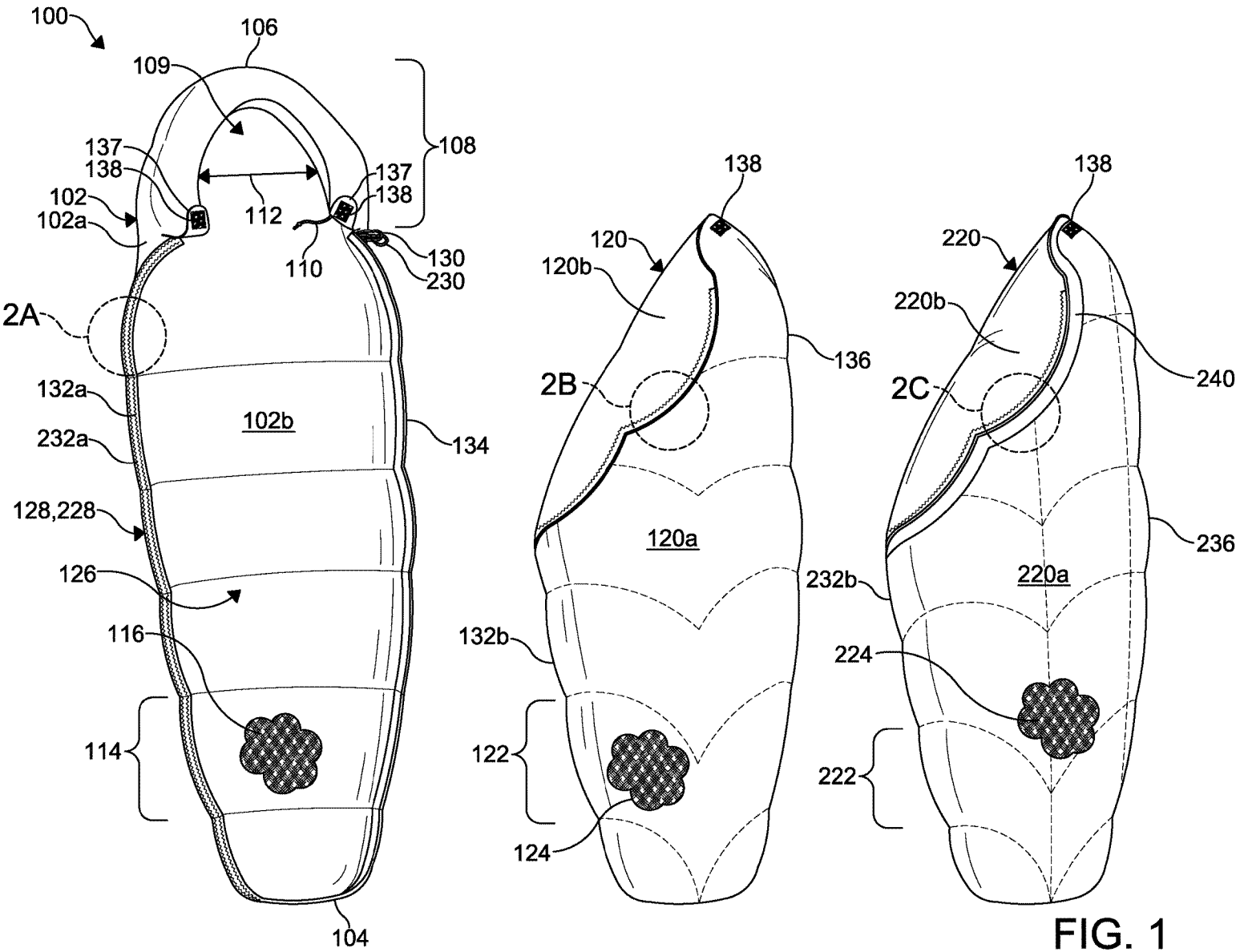
FIG. 1 is an exploded perspective view of a sleeping bag in accordance with aspects of the present disclosure.
Figure 2A:
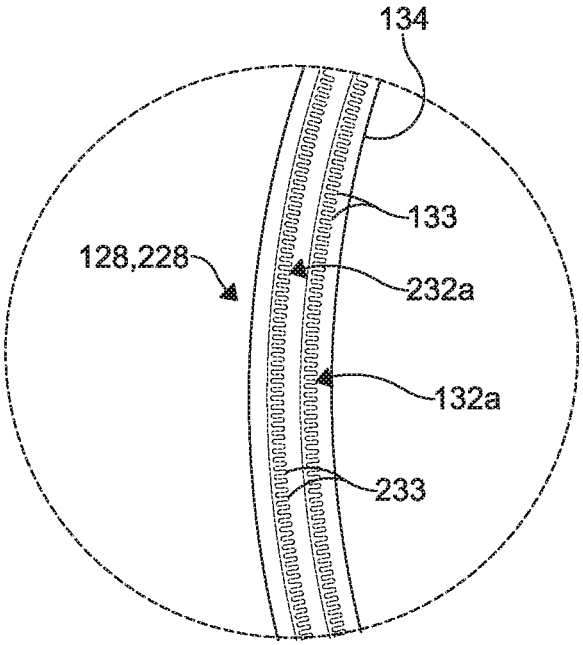
FIG. 2A. is an enlarged view of a fastener mechanism disposed on a bottom panel of the sleeping bag shown in FIG. 1.
Figure 2B:
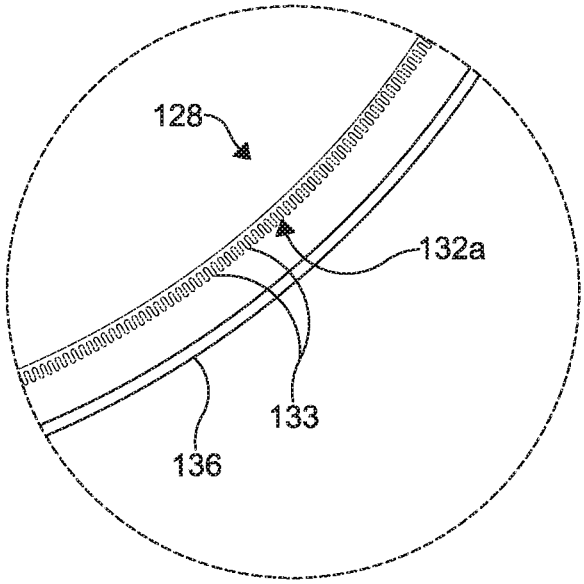
FIG. 2B. is an enlarged view of a fastener mechanism disposed on a first top panel of the sleeping bag shown in FIG. 1.
Figure 2C:
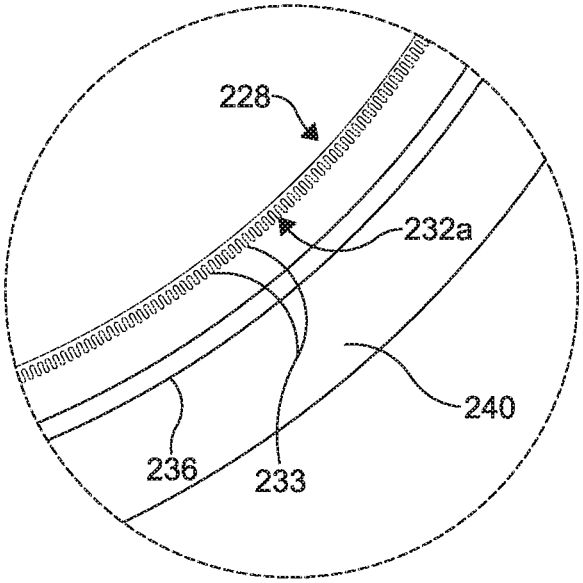
FIG. 2C. is an enlarged view of a fastener mechanism disposed on a second top panel of the sleeping bag shown in FIG. 1.
Figure 3:
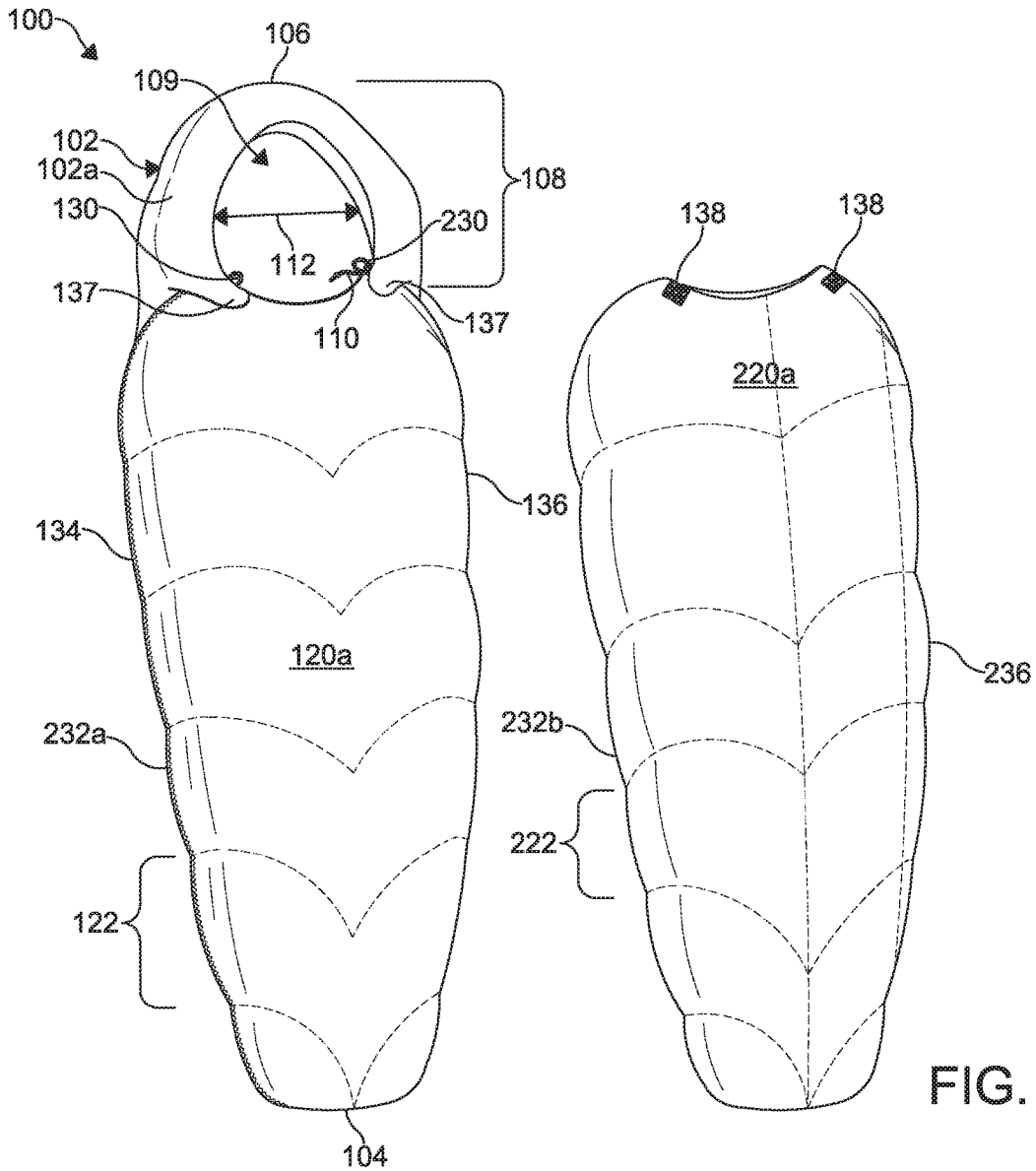
FIG. 3 is a perspective view of the sleeping bag of FIG. 1 showing a first top panel coupled to a bottom panel and a second top panel detached from the bottom panel to provide a first climate zone in accordance with aspects of the present disclosure.
Figure 4:
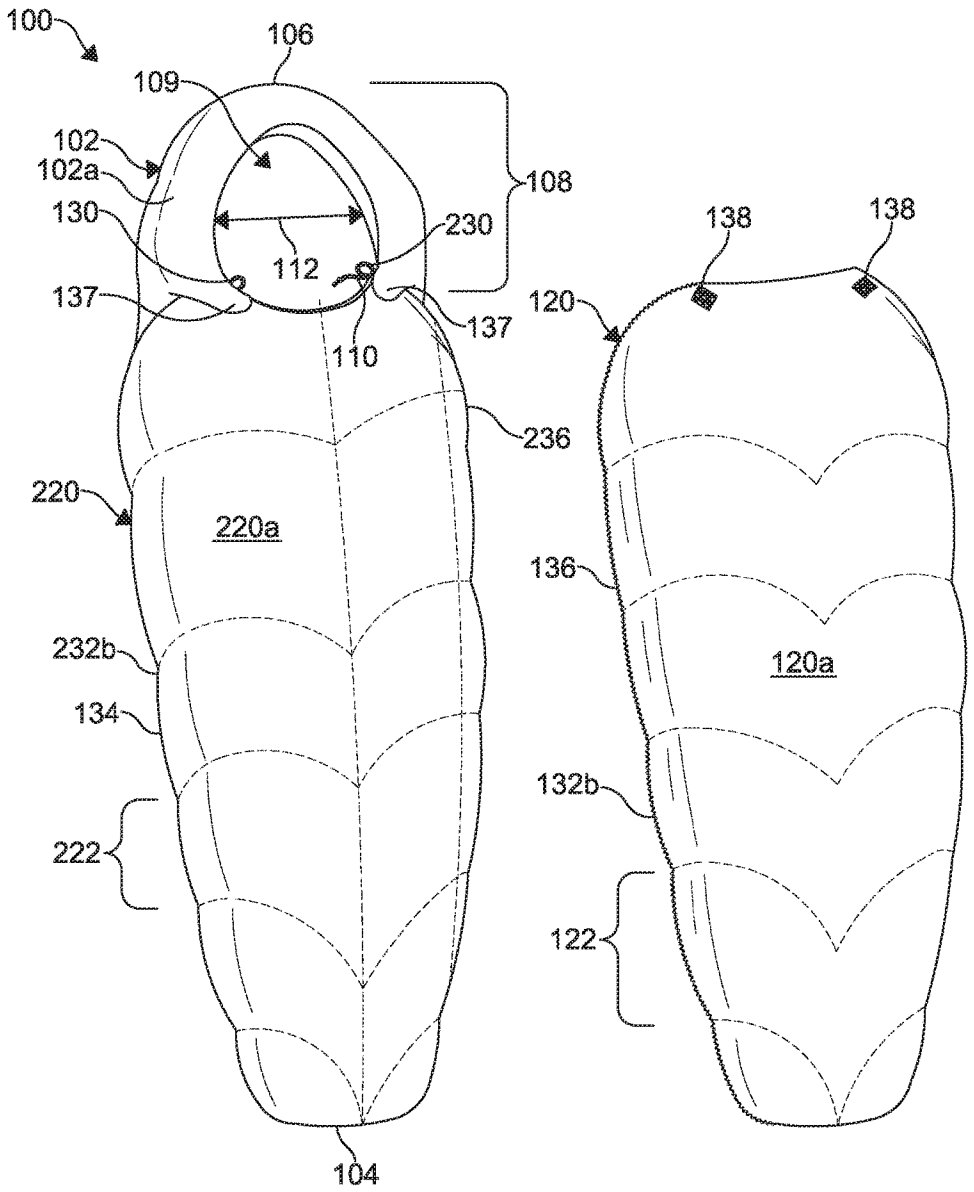
FIG. 4 is a perspective view of the sleeping bag of FIG. 1 showing the second top panel coupled to the bottom panel and the first top panel detached from the bottom panel to provide a second climate zone in accordance with aspects of the present disclosure.
Figure 5:
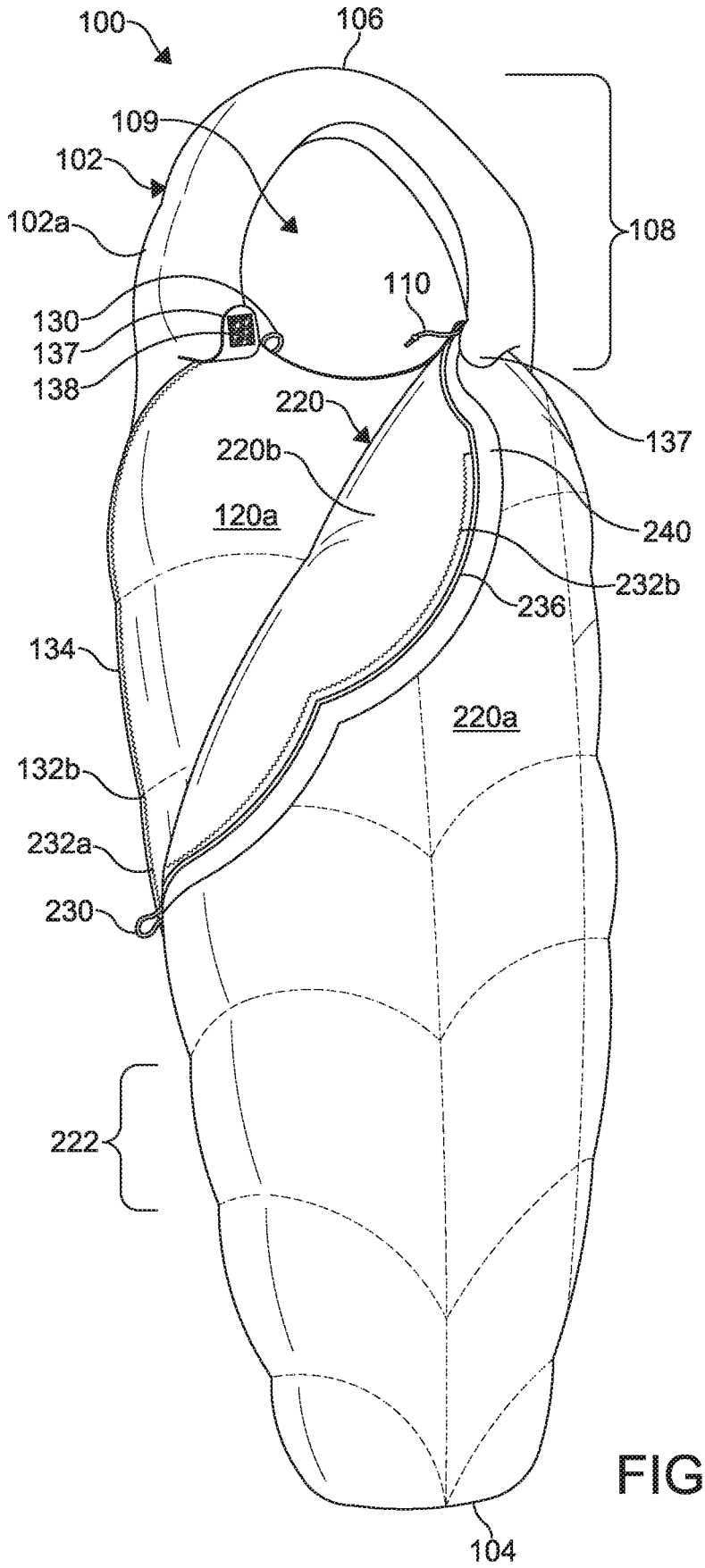
FIG. 5 is a perspective view of the sleeping bag of FIG. 1 showing both the first top panel and the second top panel coupled to the bottom panel to provide a third climate zone in accordance with aspects of the present disclosure, wherein the second to panel is shown partial decoupled from the bottom panel to illustrate an example coupling/decoupling process.

In this respect, before explaining at least one embodiment of the invention in detail, it is to be understood that the invention is not limited in its application to the details of construction and to the arrangements of the components set forth in the following description or illustrated in the drawings. The invention is capable of embodiments or embodiments in addition to those described and of being practiced and carried out in various ways. Also, it is to be understood that the phraseology and terminology employed herein, as well as the abstract, are for the purpose of description and should not be regarded as limiting.

Reference in this application to "one embodiment," "an embodiment," "one or more embodiments," "aspects," or the like means that a particular feature, structure, or characteristic described in connection with the embodiment is included in at least one embodiment of the disclosure. The appearances of, for example, the phrases "an embodiment" in various places in the specification are not necessarily all referring to the same embodiment, nor are separate or alternative embodiments mutually exclusive of other embodiments. Moreover, various features are described which may be exhibited by some embodiments and not by the other. Similarly, various requirements are described which may be requirements for some embodiments but not by other embodiments.

The following exemplary embodiments are provided so that the present disclosure will be thorough and fully convey the scope to those skilled in the art. Numerous specific details are set forth such as examples of specific components, devices and schematic configurations to provide a thorough understanding of exemplary embodiments of the present disclosure. However, it will be apparent to those skilled in the art that these specific details need not be employed, that the exemplary embodiments may be embodied in many different forms, and that neither should be construed to limit the scope of the present disclosure.

Multi-climate sleeping bags are described herein that may be selectively configured to be operable in various climate zones. For example, by selectively configuring one or more detachable top panels from a bottom panel, a sleeping compartment may be configured to exhibit a variable comfort and/or limit temperature rating ranging as measured using EN standard testing such as EN 13537. As such, a user may configure the sleeping bag for various conditions rather than having to select different sleeping bags for different expected conditions.

FIG. 1 illustrates an exploded perspective view of an exemplary sleeping bag 100 in accordance with an aspect of the present disclosure. The sleeping bag 100 may be configured as a multi-climate sleeping bag allowing a user to configure the sleeping bag 100 in various climate zone configurations. As an example, the sleeping bag 100 may be selectively configurable in three climate zone configurations, such as a first climate zone comprising a limit rating of 35° F. (or about 35° F.) and above, a second climate zone comprising a limit rating of 20° F. (or about 20° F.) and above, and a third climate zone comprising a limit rating of 5° F. (or about 5° F.) and above, as measured using EN standard testing such as EN 13537, for example. Other configurations and associated climate zones may be used, such as two, three, or more climate zones having different limit ratings using the EN standard. As used herein, in reference to measurements using the EN standard, the term "about" may include +/−3° F. as is contemplated by the EN testing procedure. Additionally, it is understood that such tolerance may be affected as testing is conducted in conditions of temperatures below 20° F., for example.

The sleeping bag 100 may comprise a bottom panel 102 having a foot end 104 and a head end 106 disposed opposite the foot end 104. The foot end 104 corresponds to the end of sleeping bag 100 which is intended to receive a user's legs and feet (e.g., foot box). The foot end 104 may be configured as to have a generally trapezoidal shape. However, other shapes may be used. The head end 106 corresponds to the end of sleeping bag 100 which is intended to receive a user's head and upper body. A hood 108 may be disposed adjacent the head end 106. The hood 108 may define cavity 109 configured to receive a head of the user. The cavity 109 may be sized and/or shaped to receive a pillow and the head of the user. A cord 110 may be configured to facilitate constrictions and/or expansion of an aperture 112 defined at least partially by the hood 108. As an example, the aperture 112 may be disposed to allow a user to selectively see out of the sleeping bag 100. However, constriction of the aperture 112 may be used to cover and protect a face of the user.

The bottom panel 102 may be formed from an outer shell 102*a* and an inner shell 102*b*. Materials, such as nylon, polyester, microfiber, rubber, and combinations thereof may be used to form the exterior surfaces defined by the outer shell 102*a* and the interior surfaces defined by inner shell 102*b* (e.g., liner). A plurality of internal baffle structures such as baffles 114 may be configured to locate and maintain an insulating material 116 disposed between the outer shell 102*a* and the inner shell 102*b* in desired positions longitudinally and circumferentially along the length of sleeping bag 100. The insulating material 116 may comprise a water-fowl down and/or a water-resistant down material, for example. The baffles 114 may be coupled to the outer shell 102*a* and the inner shell 102*b* by suitable means such as, for example, sewing, weaving, or adhesives. Additionally, or alternatively, an offset quilted or shingled synthetic insulation may be disposed between the shells 102*a*, 102*b*. The bottom panel 102 may comprise an anti-compression layer (not shown).

A first top panel 120 may be formed from an outer shell 120*a* and an inner shell 120*b*. Materials, such as nylon, polyester, microfiber, rubber, and combinations thereof may be used to form the exterior surfaces defined by the outer shell 120*a* and the interior surfaces defined by inner shell 120*b*. A plurality of internal baffle structures such as baffles 122 may be configured to locate and maintain an insulating material 124 disposed between the outer shell 120*a* and the inner shell 120*b* in desired positions longitudinally and circumferentially along the length of the first top panel 120. Additionally, or alternatively, an offset quilted or shingled synthetic insulation may be disposed between the shells 120*a*, 120*b*.

The first top panel 120 may be be selectively coupled to the bottom panel 102 to at least partially define a sleeping compartment 126. As an example, a fastener mechanism 128 may be configured to detachably couple the first top panel 120 to the bottom panel 102. As a further example, the fastener mechanism 128 may be or comprise a zipper-type fastener comprising a pull 130 and a pair of slider paths 132*a*, 132*b* having a plurality of teeth 133 configured to be engaged by the pull 130 to couple the slider paths 132*a*, 132*b* together. As shown, one of the slider paths 132*a* may be disposed along a peripheral edge 134 of the bottom panel 102 and the slider path 132*b* may be disposed along a peripheral edge 136 of the first top panel 120. The slider paths 132*a*, 132*b* may be configured to facilitate detachment (e.g., complete decoupling and separation) of the first top panel 120 from the bottom panel 102. As such, the pull 130 may be engaged to selectively couple and decouple the edges 134, 136 to each other. When the first top panel 120 is coupled to the bottom panel 102, the sleeping compartment 126 may be configured to operate in a first climate zone. The first climate zone may comprise a limit rating of 35° F. (about 35° F.) and above, as measured using EN standard testing, such as EN 13537, for example. Other climate zones may be created using the first top panel 120. For example, the first top panel 120 may be configured as a partial panel that does not enclose an entirety of the sleeping compartment 126. Although not shown, it is contemplated that various shapes and partial configurations may be implemented to create flexibility in defining a climate zone. As an example, a partial top panel (not shown) may comprise a half to three-quarter length panel (as compared to a full panel or the length of the sleeping bag) and may be detachably coupled to the bottom panel 102. Various fasteners may be used such as zippers, snaps, toggles, etc. The partial top layer may be formed form a single layer of material (e.g., fleece, quilted material, etc.) or may be a shell configuration including an outer and inner shell with or without insulating material disposed therebetween. The partial shell may be configured to cover various portions of a user's body, for example, a chest area. Other configurations may be used.

A second top panel 220 may be formed from an outer shell 220*a* and an inner shell 220*b*. Materials, such as nylon, polyester, microfiber, rubber, and combinations thereof may be used to form the exterior surfaces defined by the outer shell 220*a* and the interior surfaces defined by inner shell 220*b*. A plurality of internal baffle structures such as baffles 222 may be configured to locate and maintain an insulating material 224 disposed between the outer shell 220*a* and the inner shell 220*b* in desired positions longitudinally and circumferentially along the length of the second top panel 220. The insulating material 224 may comprise a water-fowl down and/or a water-resistant down material, for example. The baffles 222 may be coupled to the outer shell 220*a* and the inner shell 220*b* by suitable means such as, for example, sewing, weaving, or adhesives.

The second top panel 220 may be be selectively coupled to the bottom panel 102 to at least partially define the sleeping compartment 126. As an example, a fastener mechanism 228 may be configured to detachably couple the second top panel 220 to the bottom panel 102. As a further example, the fastener mechanism 228 may be or comprise a zipper-type fastener comprising a pull 230 and a pair of slider paths 232*a*, 232*b* having a plurality of teeth 233 configured to be engaged by the pull 230 to couple the slider paths 232*a*, 232*b* together. As shown, one of the slider paths 232*a* may be disposed along the peripheral edge 134 of the bottom panel 102 and the slider path 232*b* may be disposed along a peripheral edge 236 of the second top panel 220. As an example, the slider path 232*a* may be disposed adjacent (e.g., generally parallel with and/or overlaying) the slider path 132*a*. The slider path 232*a* may be disposed radially outwardly from the slider path 132*a*. The slider paths 232*a*, 232*b* may be configured to facilitate detachment (e.g., complete decoupling and separation) of the second top panel 220 from the bottom panel 102.

As such, the pull 230 may be engaged to selectively couple and decouple the edges 134, 236 to each other. The pulls 130,230 may be selectively used to engage various combinations of the slider paths 132*a-b*, 232*a-b* to enable the top panels 120, 220 to be coupled to the bottom panel 102 in various configurations. For example, either one of the top panels 120, 220 may be coupled to the bottom panel 102 via the slider path 132*a* or the slider path 232*a*. When the second top panel 220 is coupled to the bottom panel 102, the sleeping compartment 126 may be configured to operate in a second climate zone different from the first climate zone. The second climate zone may comprise a limit rating 20° F. (about 20° F.) and above, as measured using EN standard testing, such as EN 13537, for example. Other climate zones may be created using the second top panel 220. For example, the second top panel 220 may be configured as a partial panel that does not enclose an entirety of the sleeping compartment 126. Although not shown, it is contemplated that various shapes and partial configurations may be implemented to create flexibility in defining a climate zone. The sleeping bag 100 may comprise one or more thermal management features or elements such as a draft tube. As an example, a draft tube 240 is illustrated extending along the edge 236 of the second top panel 220. As such, the draft tube 240 may comprise material to overlay at least a portion of the edge 236 and/or the fastener mechanism 228 to provide a barrier or insulation over such a portion. It is understood that other draft tubes may be disposed adjacent various portions of the sleeping bag 100, such as adjacent the edge 136 and/or the fastener mechanism 128.

In certain aspects, the pull 130 may be engaged to selectively couple and decouple the edges 134, 136 to each other. In reference to the coupling/decoupling of the edges 134, 136, it is understood that the edges 134, 136 may be defined as a portion of the sleeping bag 100 configured to be releasably affixed to a detachable portion. The term edge 134, 136 may be defined by an outermost periphery, or may include material such as a draft tube extending adjacent thereto and overlaying the edge. Additionally, the pull 230 may be engaged to selectively couple and decouple the edges 134, 236 to each other. When both the first top panel 120 and the second top panel 220 are coupled to the bottom panel 102, the sleeping compartment 126 may be configured to operate in a third climate zone that may be different from the first climate zone and the second climate zone. The third climate zone may comprise 5° F. (about 5° F.) and above, as measured using EN standard testing, such as EN 13537, for example. As described herein, a user may selectively couple the first top panel 120 or the second top panel 220 to the bottom panel 102 based on climate conditions. Additionally, or alternatively, the user may couple both the first top panel 120 and the second top panel 220 to the bottom panel 102 in a stacked configuration. As an example, the first top panel 120 may be interposed between the bottom panel 102 and the second top panel 220 to facilitate the coldest climate configuration of the sleeping bag 100.

Alternatively or additionally, the sleeping bag 100 may comprise one or more flaps 137 configured to detachably couple a portion of the hood to one or more of the first top panel 120 and the second top panel 220. For example, the flaps 137 may be attached to the hood 108 or other portion of the bottom panel 102. As another example, the flaps 137 may comprise a detachable coupler 138 such as a snap, button, hook and loop fastener, and the like, configured to detachably engage a portion of one or more of the first top panel 120 and the second top panel 220. As a further example, the flaps 137 may be configured to overlay at least a portion of the slider paths 132*a*, 132*b*, 232*a*, 232*b* and/or the pulls 130, 230 to secure the pulls 130, 230 in a coupled position.

In various aspects, the present disclosure may pertain to one or more of the following examples.

EXAMPLE 1

A multi-climate sleeping bag comprising: a bottom panel comprising a head end and a foot end disposed opposite the head end, the bottom panel further comprising a hood disposed adjacent the head end, wherein the bottom panel is formed from an inner shell, an outer shell, and an insulating material disposed between the inner shell and the outer shell; a first top panel comprising an inner shell, an outer shell, and an insulating material disposed between the inner shell and the outer shell; a first zipper-type fastener mechanism configured to detachably couple an edge of the first top panel to an edge of the bottom panel, wherein the first zipper-type fastening mechanism comprises a first pull configured to engage and couple a first slider path disposed along the edge of the bottom panel and a second slider path disposed along the edge of the first top panel; and a second top panel comprising an inner shell, an outer shell, and an insulating material disposed between the inner shell and the outer shell; and a second zipper-type fastener mechanism configured to detachably couple an edge of the second top panel to the edge of the bottom panel, wherein the second zipper-type fastening mechanism comprises a second pull configured to engage and couple a third slider path disposed along the edge of the bottom panel and a fourth slider path disposed along the edge of the second top panel, wherein, the first top panel is configured to be coupled to the bottom panel without the second top panel to define a sleeping compartment having a first climate zone comprising a limit rating of about 35° F. and above, as measured using EN standard testing, the second top panel is configured to be coupled to the bottom panel without the first top panel to define a sleeping compartment having a second climate zone comprising a limit rating of about 20° F. and above, as measured using EN standard testing, and both the first top panel and the second top panel are configured to be contemporaneously coupled to the bottom panel to define a sleeping compartment having a third climate zone comprising a limit rating of about 5° F. and above, as measured using EN standard testing.

EXAMPLE 2

The multi-climate sleeping bag of Example 1, further comprising a cord configured to constrict and/or expand an aperture at least partially defined by the hood.

EXAMPLE 3

The multi-climate sleeping bag of Example 2, wherein the cord is elastic.

EXAMPLE 4

The multi-climate sleeping bag of any one of Examples 1-3, wherein the insulating material of the bottom panel comprises a down material, an offset quilted material, a shingled synthetic material, or a combination thereof.

EXAMPLE 5

The multi-climate sleeping bag of any one of Examples 1-3, wherein the insulating material of the bottom panel comprises a down material.

EXAMPLE 6

The multi-climate sleeping bag of any one of Examples 1-3, wherein the insulating material of the bottom panel comprises an offset quilted material or a shingled synthetic material, or a combination thereof.

EXAMPLE 7

The multi-climate sleeping bag of any one of Examples 1-6, wherein the insulating material of the first top panel comprises a down material, an offset quilted material, a shingled synthetic material, or a combination thereof.

EXAMPLE 8

The multi-climate sleeping bag of any one of Examples 1-6, wherein the insulating material of the first top panel comprises a down material.

EXAMPLE 9

The multi-climate sleeping bag of any one of Examples 1-6, wherein the insulating material of the first top panel comprises an offset quilted material or a shingled synthetic material, or a combination thereof.

EXAMPLE 10

The multi-climate sleeping bag of any one of Examples 1-9, wherein the insulating material of the second top panel comprises a down material, an offset quilted material, a shingled synthetic material, or a combination thereof.

EXAMPLE 11

The multi-climate sleeping bag of any one of Examples 1-9, wherein the insulating material of the second top panel comprises a down material.

EXAMPLE 12

The multi-climate sleeping bag of any one of Examples 1-9, wherein the insulating material of the second top panel comprises an offset quilted material or a shingled synthetic material, or a combination thereof.

EXAMPLE 13

The multi-climate sleeping bag of any one of Examples 1-3, wherein the insulating material of the second top panel comprises a down material and the insulating material of the first top panel comprises a synthetic layer.

EXAMPLE 14

The multi-climate sleeping bag of any one of Examples 1-13, further comprising one or more flaps configured to couple the hood to one or more of the first top panel and the second top panel.

EXAMPLE 15

The multi-climate sleeping bag of Example 14, wherein the flaps are configured to overlay at least a portion of the first, second, third, or fourth slider paths to secure one or more of the first pull and the second pull in a coupled position.

EXAMPLE 16

The multi-climate sleeping bag of any one of Examples 1-15, further comprising a draft tube disposed adjacent the at least a portion of the second fastener mechanism.

EXAMPLE 17

The multi-climate sleeping bag of Example 16, wherein the draft tube is formed with or coupled to the bottom panel.

EXAMPLE 18

The multi-climate sleeping bag of Example 16, wherein the draft tube is formed with or coupled to the second top panel.

EXAMPLE 19

The multi-climate sleeping bag of any one of Examples 1-18, further comprising a draft tube disposed adjacent the at least a portion of the first fastener mechanism.

EXAMPLE 20

The multi-climate sleeping bag of Example 19, wherein the draft tube is formed with or coupled to the bottom panel.

EXAMPLE 21

The multi-climate sleeping bag of Example 19, wherein the draft tube is formed with or coupled to the first top panel.

EXAMPLE 22

A multi-climate sleeping bag comprising: a bottom panel comprising a head end and a foot end disposed opposite the head end, wherein the bottom panel is formed from an inner shell, an outer shell, and an insulating material disposed between the inner shell and the outer shell; a first top panel; a first fastener mechanism configured to detachably couple a portion of the first top panel to a portion of the bottom panel; a second top panel comprising an inner shell, an outer shell, and an insulating material disposed between the inner shell and the outer shell; and a second fastener mechanism configured to detachably couple a portion of the second top panel to a portion of the bottom panel, wherein, the first top panel is configured to be coupled to the bottom panel without the second top panel to define a sleeping compartment having a first climate zone, the second top panel is configured to be coupled to the bottom panel without the first top panel to define a sleeping compartment having a second climate zone, and both the first top panel and the second top panel are configured to be contemporaneously coupled to the bottom panel to define a sleeping compartment having a third climate zone, wherein each of the first, second, and third climate zones have a different limit rating as measured using EN standard testing.

EXAMPLE 23

The multi-climate sleeping bag of Example 22, the bottom panel further comprising a hood disposed adjacent the head end.

EXAMPLE 24

The multi-climate sleeping bag of Example 23, further comprising a cord configured to constrict and/or expand an aperture at least partially defined by the hood.

EXAMPLE 25

The multi-climate sleeping bag of Example 24, wherein the cord is elastic.

EXAMPLE 26

The multi-climate sleeping bag of any one of Examples 22-25, wherein the insulating material of the bottom panel comprises a down material, an offset quilted material, a shingled synthetic material, or a combination thereof.

EXAMPLE 27

The multi-climate sleeping bag of any one of Examples 22-25, wherein the insulating material of the bottom panel comprises a down material.

EXAMPLE 28

The multi-climate sleeping bag of any one of Examples 22-25, wherein the insulating material of the bottom panel comprises an offset quilted material or a shingled synthetic material, or a combination thereof.

EXAMPLE 29

The multi-climate sleeping bag of any one of Examples 22-28, wherein the insulating material of the first top panel comprises a down material, an offset quilted material, a shingled synthetic material, or a combination thereof.

EXAMPLE 30

The multi-climate sleeping bag of any one of Examples 22-28, wherein the insulating material of the first top panel comprises a down material.

EXAMPLE 31

The multi-climate sleeping bag of any one of Examples 22-28, wherein the insulating material of the first top panel comprises an offset quilted material or a shingled synthetic material, or a combination thereof.

EXAMPLE 32

The multi-climate sleeping bag of any one of Examples 22-31, wherein the insulating material of the second top panel comprises a down material, an offset quilted material, a shingled synthetic material, or a combination thereof.

EXAMPLE 33

The multi-climate sleeping bag of any one of Examples 22-31, wherein the insulating material of the second top panel comprises a down material.

EXAMPLE 34

The multi-climate sleeping bag of any one of Examples 22-31, wherein the insulating material of the second top panel comprises an offset quilted material or a shingled synthetic material, or a combination thereof.

EXAMPLE 35

The multi-climate sleeping bag of any one of Examples 22-25, wherein the insulating material of the second top panel comprises a down material and the insulating material of the first top panel comprises a synthetic layer.

EXAMPLE 36

The multi-climate sleeping bag of any one of Examples 22-35, further comprising one or more flaps configured to couple the hood to one or more of the first top panel and the second top panel.

EXAMPLE 37

The multi-climate sleeping bag of Example 36, wherein the flaps are configured to overlay at least a portion of the first, second, third, or fourth slider paths to secure one or more of the first pull and the second pull in a coupled position.

EXAMPLE 38

The multi-climate sleeping bag of any one of Examples 22-37, further comprising a draft tube disposed adjacent the at least a portion of the second fastener mechanism.

EXAMPLE 39

The multi-climate sleeping bag of Example 38, wherein the draft tube is formed with or coupled to the bottom panel.

EXAMPLE 40

The multi-climate sleeping bag of Example 38, wherein the draft tube is formed with or coupled to the second top panel.

EXAMPLE 41

The multi-climate sleeping bag of any one of Examples 22-40, further comprising a draft tube disposed adjacent the at least a portion of the first fastener mechanism.

EXAMPLE 42

The multi-climate sleeping bag of Example 41, wherein the draft tube is formed with or coupled to the bottom panel.

EXAMPLE 43

The multi-climate sleeping bag of Example 41, wherein the draft tube is formed with or coupled to the first top panel.

EXAMPLE 44

The multi-climate sleeping bag of any one of Examples 22-43, wherein the second climate zone has a limit rating that is lower in temperature than a limit rating of the first climate zone.

EXAMPLE 45

The multi-climate sleeping bag of any one of Examples 22-44, wherein the third climate zone has a limit rating that is lower in temperature than a limit rating of one or more of the first climate zone and the second climate zone.

EXAMPLE 46

The multi-climate sleeping bag of any one of Examples 22-45, wherein the first climate zone has a limit rating comprising 35° F.

EXAMPLE 47

The multi-climate sleeping bag of any one of Examples 22-45, wherein the first climate zone has a limit rating comprising 40° F.

EXAMPLE 48

The multi-climate sleeping bag of any one of Examples 22-45, wherein the first climate zone has a limit rating comprising 45° F.

EXAMPLE 49

The multi-climate sleeping bag of any one of Examples 22-45, wherein the first climate zone has a limit rating comprising 50° F.

EXAMPLE 50

The multi-climate sleeping bag of any one of Examples 22-45, wherein the first climate zone has a limit rating comprising 55° F.

EXAMPLE 51

The multi-climate sleeping bag of any one of Examples 22-50, wherein the second climate zone has a limit rating comprising 15° F.

EXAMPLE 52

The multi-climate sleeping bag of any one of Examples 22-50, wherein the second climate zone has a limit rating comprising 20° F.

EXAMPLE 53

The multi-climate sleeping bag of any one of Examples 22-50, wherein the second climate zone has a limit rating comprising 25° F.

EXAMPLE 54

The multi-climate sleeping bag of any one of Examples 22-50, wherein the second climate zone has a limit rating comprising 30° F.

EXAMPLE 55

The multi-climate sleeping bag of any one of Examples 22-45 and 47-50, wherein the second climate zone has a limit rating comprising 35° F.

EXAMPLE 56

The multi-climate sleeping bag of any one of Examples 22-55, wherein the third climate zone has a limit rating comprising 0° F.

EXAMPLE 57

The multi-climate sleeping bag of any one of Examples 22-55, wherein the third climate zone has a limit rating comprising 5° F.

EXAMPLE 58

The multi-climate sleeping bag of any one of Examples 22-55, wherein the third climate zone has a limit rating comprising 10° F.

EXAMPLE 59

The multi-climate sleeping bag of any one of Examples 22-50 and 53-55, wherein the third climate zone has a limit rating comprising 15° F.

EXAMPLE 60

The multi-climate sleeping bag of any one of Examples 22-50 and 53-55, wherein the third climate zone has a limit rating comprising 20° F.

Other climate zones may be implemented beyond the end points enumerated in the above examples. Such examples are not intended to be limiting to the various climate zone configurations contemplated by the present disclosure.

EXAMPLE 61

A method of making a multi-climate sleeping bag, the method comprising: forming a bottom panel comprising a head end and a foot end disposed opposite the head end, wherein the bottom panel is formed from an inner shell, an outer shell, and an insulating material disposed between the inner shell and the outer shell; forming a first top panel comprising an inner shell, an outer shell, and an insulating material disposed between the inner shell and the outer shell; and forming a second top panel comprising an inner shell, an outer shell, and an insulating material disposed between the inner shell and the outer shell, wherein the one or more of the first top panel and the second top panel are configured to selectively couple and decouple to the bottom panel to define a sleeping compartment, wherein, the first top panel is configured to be coupled to the bottom panel without the second top panel to define a sleeping compartment having a first climate zone, the second top panel is configured to be coupled to the bottom panel without the first top panel to define a sleeping compartment having a second climate zone, and both the first top panel and the second top panel are configured to be contemporaneously coupled to the bottom panel to define a sleeping compartment having a third climate zone, wherein each of the first, second, and third climate zones have a different limit rating as measured using EN standard testing.

EXAMPLE 62

The method of Example 61, wherein the first climate zone comprises a limit rating of about 35° F. and above, as measured using EN standard testing, the second climate zone comprises a limit rating of about 20° F. and above, as measured using EN standard testing, and the third climate zone comprises a limit rating of about 5° F. and above, as measured using EN standard testing.

EXAMPLE 63

The method of any one of Examples 61-62, wherein the second climate zone has a limit rating that is lower in temperature than a limit rating of the first climate zone, and wherein the third climate zone has a limit rating that is lower in temperature than a limit rating of one or more of the first climate zone and the second climate zone.

While the system and method have been described in terms of what are presently considered to be specific embodiments, the disclosure need not be limited to the disclosed embodiments. It is intended to cover various modifications and similar arrangements included within the spirit and scope of the claims, the scope of which should be accorded the broadest interpretation so as to encompass all such modifications and similar structures.

What is claimed is:

1. A multi-climate sleeping bag comprising:

a bottom panel comprising a head end and a foot end disposed opposite the head end, the bottom panel further comprising a hood disposed adjacent the head end, wherein the bottom panel is formed from an inner shell, an outer shell, and an insulating material disposed between the inner shell and the outer shell;

a first top panel comprising an inner shell, an outer shell, and an insulating material disposed between the inner shell and the outer shell;

a first zipper fastening mechanism configured to detachably couple an edge of the first top panel to an edge of the bottom panel, wherein the first zipper fastening mechanism comprises a first pull configured to engage and couple a first slider path disposed along the edge of the bottom panel and a second slider path disposed along the edge of the first top panel; and a second top panel comprising an inner shell, an outer shell, and an insulating material disposed between the inner shell and the outer shell; and a second zipper fastening mechanism configured to detachably couple an edge of the second top panel to the edge of the bottom panel, wherein the second zipper fastening mechanism comprises a second pull configured to engage and couple a third slider path disposed along the edge of the bottom panel and a fourth slider path disposed along the edge of the second top panel, wherein, the first top panel is configured to be coupled to the bottom panel without the second top panel to define a sleeping compartment having a first climate zone comprising a limit rating of 35° F. and above, as measured using EN standard testing, wherein the second top panel is decoupled from the bottom panel to define the sleeping compartment having the first climate zone, the second top panel is configured to be coupled to the bottom panel without the first top panel to define a sleeping compartment having a second climate zone comprising a limit rating of 20° F. and above, as measured using EN standard testing, wherein the first top panel is decoupled from the bottom panel to define the sleeping compartment having the second climate zone, and both the first top panel and the second top panel are configured to be contemporaneously coupled to the bottom panel to define a sleeping compartment having a third climate zone comprising a limit rating of 5° F. and above, as measured using EN standard testing.

2. The multi-climate sleeping bag of claim 1, further comprising a cord configured to constrict and/or expand an aperture at least partially defined by the hood.

3. The multi-climate sleeping bag of claim 1, wherein the insulating material of the bottom panel comprises a down material, an offset quilted material, a shingled synthetic material, or a combination thereof.

4. The multi-climate sleeping bag of claim 1, wherein the insulating material of the first top panel comprises a down material, an offset quilted material, a shingled synthetic material, or a combination thereof.

5. The multi-climate sleeping bag of claim 1, wherein the insulating material of the second top panel comprises a down material, an offset quilted material, a shingled synthetic material, or a combination thereof.

6. The multi-climate sleeping bag of claim 1, further comprising one or more flaps configured to couple the hood to one or more of the first top panel and the second top panel.

7. The multi-climate sleeping bag of claim 6, wherein the flaps are configured to overlay at least a portion of the first, second, third, or fourth slider paths to secure one or more of the first pull and the second pull in a coupled position.

8. The multi-climate sleeping bag of claim 1, further comprising a draft tube disposed adjacent the at least a portion of the second zipper fastening mechanism.

9. A multi-climate sleeping bag comprising:

a bottom panel comprising a head end and a foot end disposed opposite the head end, wherein the bottom panel is formed from an inner shell, an outer shell, and an insulating material disposed between the inner shell and the outer shell;

a first top panel;

a first fastener mechanism configured to detachably couple a portion of the first top panel to a portion of the bottom panel;

a second top panel comprising an inner shell, an outer shell, and an insulating material disposed between the inner shell and the outer shell; and a second fastener mechanism configured to detachably couple a portion of the second top panel to a portion of the bottom panel, wherein, the first top panel is configured to be coupled to the bottom panel without the second top panel to define a sleeping compartment having a first climate zone, wherein the second top panel is decoupled from the bottom panel to define the sleeping compartment having the first zone, the second top panel is configured to be coupled to the bottom panel without the first top panel to define a sleeping compartment having a second climate zone, wherein the first top panel is decoupled from the bottom panel to define the sleeping compartment having the second climate zone, and both the first top panel and the second top panel are configured to be contemporaneously coupled to the bottom panel to define a sleeping compartment having a third climate zone, wherein each of the first, second, and third climate zones have a different limit rating as measured using EN standard testing.

10. The multi-climate sleeping bag of claim 9, wherein the bottom panel further comprising a hood disposed adjacent the head end.

11. The multi-climate sleeping bag of claim 10, further comprising a cord configured to constrict and/or expand an aperture at least partially defined by the hood.

12. The multi-climate sleeping bag of claim 9, wherein the insulating material of the bottom panel comprises one or more of a down material, an offset quilted material, a shingled synthetic material, or a combination thereof.

13. The multi-climate sleeping bag of claim 9, wherein the first top panel comprises an inner shell, an outer shell, and an insulating material disposed between the inner shell and the outer shell, the insulating material of the first top panel comprises a down material, an offset quilted material, a shingled synthetic material, or a combination thereof.

14. The multi-climate sleeping bag of claim 9, wherein the insulating material of the second top panel comprises a down material, an offset quilted material, a shingled synthetic material, or a combination thereof.

15. The multi-climate sleeping bag of claim 9, further comprising a draft tube disposed adjacent the at least a portion of the second fastener mechanism.

16. The multi-climate sleeping bag of claim 9, wherein the second climate zone has a limit rating for a lower temperature than a limit rating of the first climate zone.

17. The multi-climate sleeping bag of claim 9, wherein the third climate zone has a limit rating for a lower temperature than a limit rating of one or more of the first climate zone and the second climate zone.

* * * * *